US007088259B2

(12) United States Patent
Armbruster et al.

(10) Patent No.: US 7,088,259 B2
(45) Date of Patent: Aug. 8, 2006

(54) INFANT MONITOR

(75) Inventors: Michael D. Armbruster, Buffalo, NY (US); Karen Fitzgerald, Elma, NY (US)

(73) Assignee: Mattel, Inc., El Segundo, CA (US)

( * ) Notice: Subject to any disclaimer, the term of this patent is extended or adjusted under 35 U.S.C. 154(b) by 82 days.

(21) Appl. No.: 10/822,728

(22) Filed: Apr. 13, 2004

(65) Prior Publication Data

US 2004/0217868 A1 Nov. 4, 2004

Related U.S. Application Data

(60) Provisional application No. 60/466,736, filed on May 1, 2003.

(51) Int. Cl.
*G08B 5/00* (2006.01)

(52) U.S. Cl. ..... 340/815.46; 340/815.4; 340/815.42; 340/691.2; 340/514

(58) Field of Classification Search ..... None
See application file for complete search history.

(56) References Cited

U.S. PATENT DOCUMENTS 3,480,912 A * 11/1969 Speeth et al. ..... 368/197
5,210,532 A * 5/1993 Knoedler et al. ..... 340/825.69
5,768,696 A * 6/1998 Law ..... 455/127.1
5,949,346 A * 9/1999 Suzuki et al. ..... 340/815.45
6,135,606 A * 10/2000 Fernandez et al. ..... 362/109
6,311,837 B1 * 11/2001 Blaustein et al. ..... 206/362.2
6,462,664 B1 * 10/2002 Cuijpers et al. ..... 340/573.1
6,759,961 B1 * 7/2004 Fitzgerald et al. ..... 340/573.1
2001/0034181 A1 * 10/2001 Bakst ..... 446/242
2003/0162558 A1 * 8/2003 Takase et al. ..... 455/550
2003/0231778 A1 * 12/2003 Landa ..... 381/77

* cited by examiner

*Primary Examiner*—Benjamin C. Lee
*Assistant Examiner*—Son Tang
(74) *Attorney, Agent, or Firm*—Edell, Shapiro & Finnan, LLC

(57) ABSTRACT

In accordance with the present invention, a parent unit (receiver) of an infant monitor includes an electronics housing, an antenna, a speaker, and a visual light display portion. In one embodiment, the light display portion is mounted on the front surface of the monitor. In another embodiment, the light display portion is mounted in conjunction with the antenna. The light display portion may include elongate light display members associated with individual light sources (LEDs). Also in accordance with the present invention, a parent unit of an infant monitor includes an LED test or LED "try-me" switch which allows the parent to both test the visual output of the light display portion of the parent unit (prior to purchase) and test the functioning of the light display portion (after purchase and removal from the packaging) without actually receiving actual sound-representative signals from the infant unit (transmitter).

13 Claims, 6 Drawing Sheets

INFANT MONITOR

CROSS REFERENCE TO RELATED APPLICATION

This application claims priority from U.S. Provisional Patent Application Ser. No. 60/466,736, filed May 1, 2003, and entitled "Monitor with Improved Light Display and Light Display Test Switch," the disclosure of which is incorporated herein by reference in its entirety.

FIELD OF THE INVENTION

The present invention relates to a infant monitor and, more particularly, to a receiver for use in combination with a transmitter to monitor the sounds made by an infant (baby). More specifically, the present invention relates to an infant monitor with an improved light display. Finally, the present invention also relates to an infant monitor with a light display test switch (a "try-me" switch).

BACKGROUND

Infant monitors are increasingly used by parents to monitor an infant while the parent goes to a different location away from the infant, such as a different room while the infant is sleeping. The typical infant monitor includes a transmitter or infant unit and a receiver or parent unit wherein the infant unit transmits sounds made by the infant to the parent unit. The parent unit then reproduces the sounds made remotely by the infant and transmitted to the parent unit from the infant unit.

In known prior art infant monitoring units, the infant unit is designed to be placed flat on its back on a table (or some other planar surface) or in some instances, may also be mounted to a wall. Furthermore, the parent unit of known prior art infant monitoring units is generally designed to be placed on a table (or some other planar surface). Known prior art parent units often include a volume adjustment knob to control the level (dB) of the sound emanating from the speaker in the parent unit.

It is also known to provide an LED (light-emitting diode) visual display such that the audible portion of the parent unit may be shut off and a series of LEDs will light up on the front face of the parent unit. The number of LEDs displayed will correspond to the intensity or loudness (dB level) of the sounds being detected by the infant unit, and being transmitted by the infant unit to the parent unit. For example, as the infant's cries become increasingly louder, more and more LEDs are illuminated to visually indicate to the parent that the sounds coming from the infant are increasing in intensity.

In the use of prior art infant monitoring systems, there has been a need for a parent unit having an LED display which may be more clearly viewed. There also exists a need for a parent unit having an LED display in which the display is more visually pleasing and may be viewed from various angles by the parent. Finally, there exists a need for an infant monitor parent unit having an LED (visual) test or LED (visual) try-me switch. This switch (which may be exposed and accessible outside of the packaging at the point of purchase) would allow the parent to both test the visual output of the parent unit (prior to purchase) and test the functioning of the LEDs (after purchase and removal from the packaging) without actually receiving signals from the infant unit.

SUMMARY

Generally, the embodiments of the present invention provide an infant monitor and, more particularly, a receiver (parent unit) for use in combination with a transmitter (infant unit) to remotely monitor the sounds made by an infant.

BRIEF DESCRIPTION OF THE DRAWINGS

Like reference numerals have been used throughout this disclosure to identify like elements.

DETAILED DESCRIPTION

In accordance with the present invention, a parent unit (receiver) of an infant monitor includes an electronics housing, an antenna, a speaker, and a visual light display portion. In one embodiment, the light display portion is mounted on the front surface of the monitor. In another embodiment, the light display portion is mounted in conjunction with the antenna. Also in accordance with the present invention, a parent unit (receiver) of an infant monitor includes an LED test or LED "try-me" switch which allows the parent to both test the visual output of the light display portion of the parent unit (prior to purchase) and test the functioning of the light display portion (after purchase and removal from the packaging) without actually receiving signals from the infant unit (transmitter).

Figure 1:
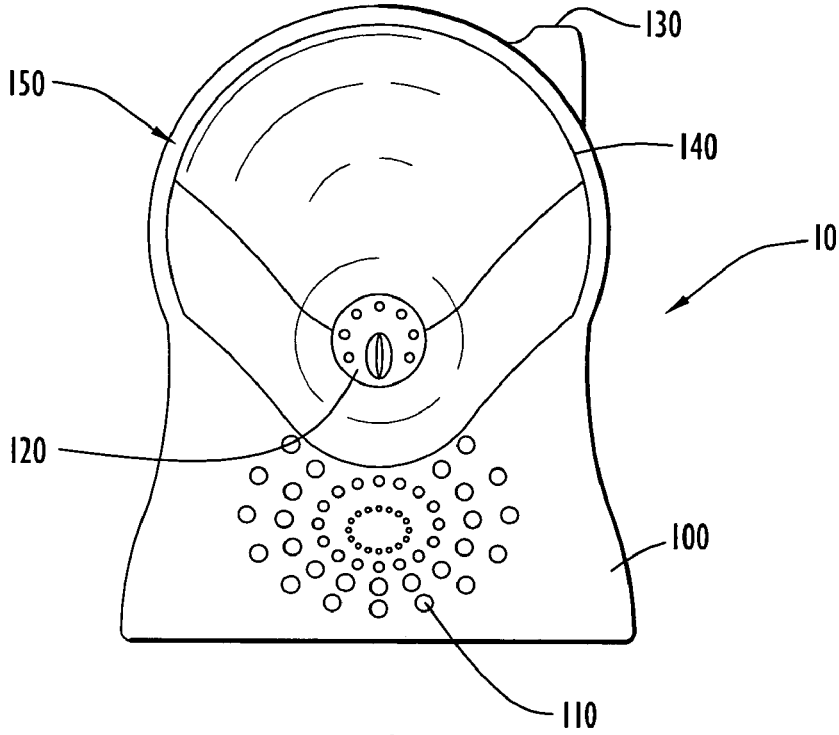
FIG. 1 illustrates a perspective view of an infant monitor according to an embodiment of the invention.

A parent unit (receiver) of an infant monitor according to an embodiment of the invention is illustrated in FIG. 1. FIG. 1 illustrates a perspective view of an infant monitor parent unit 10 according to an embodiment of the invention.

In the illustrated embodiment, parent unit 10 includes main housing 100, a speaker (not shown) mounted behind speaker openings 110, control knob 120, antenna receiving portion 130, front lens cover 140, and light display portion 150. Note that for simplicity's sake that an antenna is not illustrated in FIGS. 1–4. In accordance with the present invention, main housing 100 includes conventional electronics associated with a wireless (for example, infrared, radio frequency, or ultrasonic) infant monitor receiver. To the extent such electronics are not specifically disclosed herein, they are well known to those of ordinary skill in the relevant art.

In the illustrated embodiment, control knob 120 is a multi-function control knob that turns the parent monitor unit off and on. Control knob 120 also acts as a volume control for the speaker (not shown) mounted behind speaker openings 110. Thus, control knob 120 may functionally be used to place the parent monitor unit in a light display only mode of operation. In the light display only mode of operation, the speaker mounted behind speaker openings 10 is disabled or turned down and the illuminated portion of the light display portion 150 is visible to indicate the receipt of sound indicative signals from the infant unit (transmitter—not shown).

In the embodiment illustrated in FIG. 1, main housing 100 includes antenna receiving portion 130 for receiving an antenna (not shown). The antenna is adapted to receive signals from an infant unit (transmitter—not shown). It should be understood that in accordance with the present invention, a conventional infant unit (transmitter) with the conventional electronics associated with a wireless (for example, infrared, radio frequency, or ultrasonic) infant monitor transmitter may be utilized without departing from the scope of the present invention.

In the illustrated embodiment of the parent unit shown in FIG. 1, front lens cover 140 is mounted to main housing 100. Front lens cover 140 is mounted on the front of main housing 100 to cover light display portion 150 (shown in FIG. 2).

Figure 2:
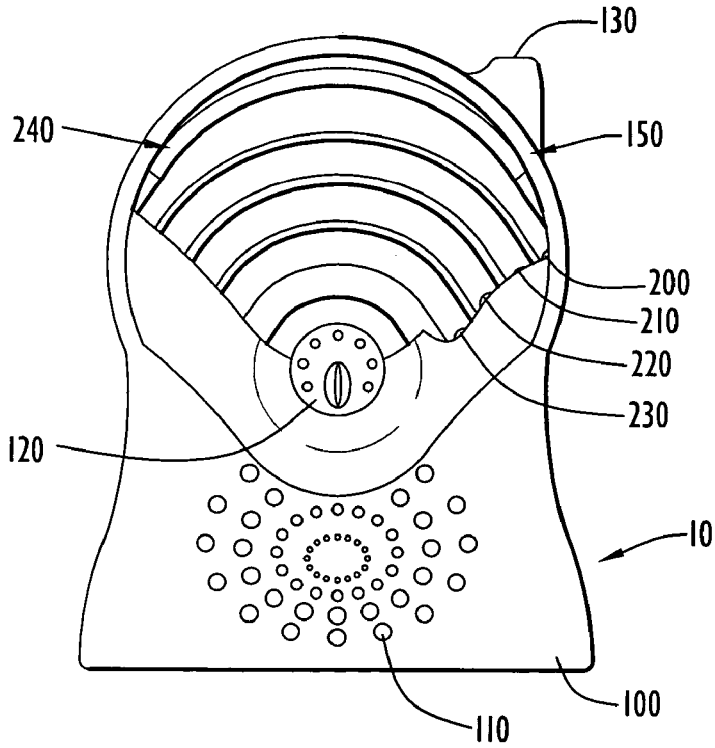
FIG. 2 illustrates a front view of an embodiment of the infant monitor of FIG. 1 with the front lens cover and light-transmitting member removed.

FIG. 2 illustrates a front view of an embodiment of the infant monitor of FIG. 1 with front lens cover 140 and light-transmitting member 400 (shown in FIGS. 4 and 6) removed. In the illustrated embodiment, light display portion 150 includes first LED 200, second LED 210, third LED 220, fourth LED 230, and light-transmitting member receiving portion 240.

The LEDs (200, 210, 220, and 230) may be designed to be illuminated sequentially (e.g., first 200, then 210, then 220, then 230) or they may be designed to be illuminated on a more random individual basis. Note that although LEDs are specifically mentioned in this application, any type of known light source (for example, grain of wheat bulb, etc.) may be utilized without departing from the scope of the present invention.

Figure 3:
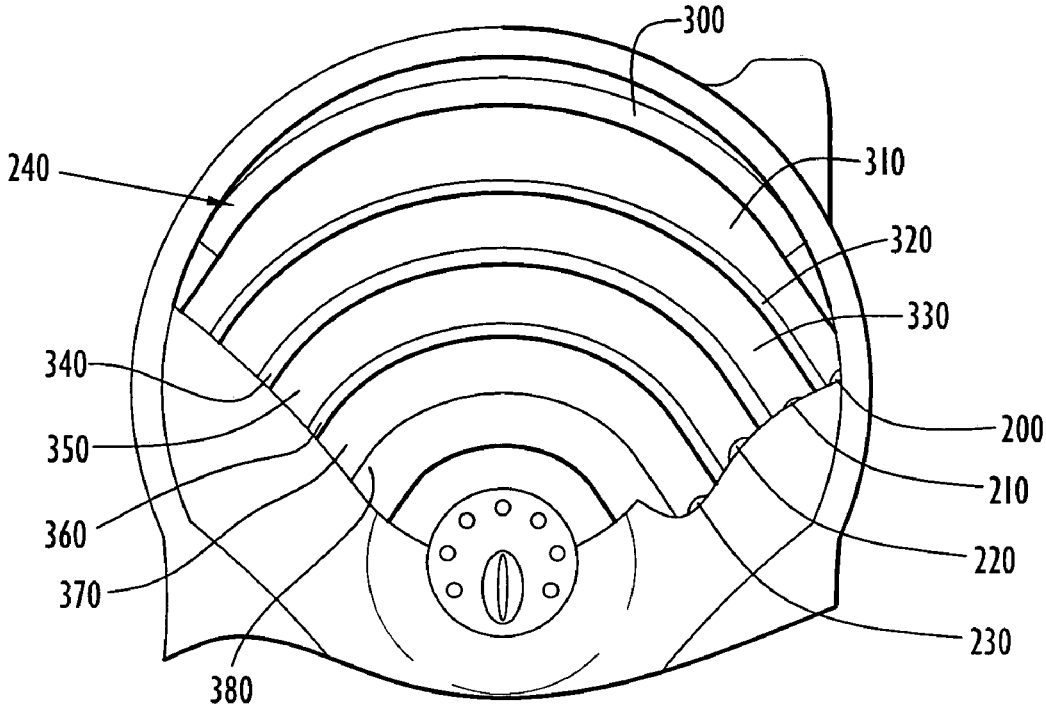
FIG. 3 illustrates a close-up view of the infant monitor of FIG. 2.

FIG. 3 illustrates a close-up view of the infant monitor of FIG. 2. As illustrated, light-transmitting member receiving portion 240 is divided into four distinct areas for receiving light-transmitting member 400 (shown in FIGS. 4 and 5). An individual portion of light-transmitting member 400 is received into each of recesses 310, 330, 350, and 370.

Each of recesses 310, 330, 350, and 370, illustrated in FIG. 3, is bounded by two side walls which prevent light leakage from one individual portion of light-transmitting member 400 to another individual portion of light-transmitting member 400. Recess 310 is bounded by side walls 300 and 320. Recess 330 is bounded by side walls 320 and 340. Recess 350 is bounded by side walls 340 and 360. Recess 370 is bounded by side walls 360 and 380. Although curvilinear recesses are illustrated in this embodiment, any shaped recess (or no recesses at all) could be utilized without departing from the scope of the present invention.

Figure 4:
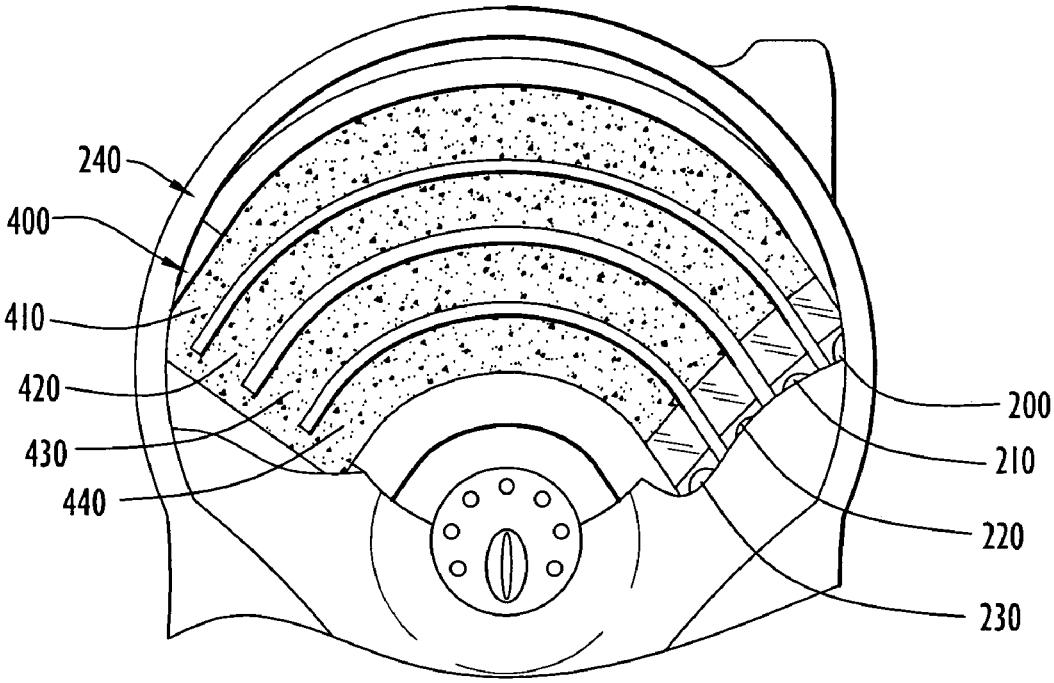
FIG. 4 illustrates a close-up view of the infant monitor of FIG. 3 with the light-transmitting member installed.

FIG. 4 illustrates a close-up view of the infant monitor of FIG. 3 with the light-transmitting member 400 installed. Light-transmitting member 400 is mounted to light-transmitting member receiving portion 240.

Light-transmitting member 400 may be made up of individual elongated light-transmitting portions 410, 420, 430, and 440. Each of the individual light-transmitting portions 410, 420, 430, and 440 can be received in a different one of the recesses 310, 330, 350, and 370 of light-transmitting member receiving portion 240. Thus, for example, light-transmitting portion 410 is received in recess 310, light-transmitting portion 420 is received in recess 330, light-transmitting portion 430 is received in recess 350, and light-transmitting portion 440 is received in recess 370.

As illustrated on the right side of FIG. 4, one end of each of the individual light-transmitting portions 410, 420, 430, and 440 is mounted in close proximity to an individual LED (200, 210, 220, and 230 respectively). Therefore, each LED only illuminates one individual light-transmitting portion. Thus, LED 200 only illuminates light-transmitting portion 410, LED 210 only illuminates light-transmitting portion 420, LED 220 only illuminates light-transmitting portion 430, and LED 230 only illuminates light-transmitting portion 440. Note that, as shown, light-transmitting portions 410, 420, 430, and 440 are arranged in a radial pattern (although other patterns are clearly contemplated without departing from the scope and spirit of the invention).

The front surface of each of the individual light-transmitting portions 410, 420, 430, and 440 is textured to enhance the dispersion of the light outwardly from the interior of each individual light-transmitting portion. Light-transmitting member 400 may be formed from acrylic or polycarbonate. Alternatively, light-transmitting member 400 may be formed from any light transmitting material.

Figure 5:
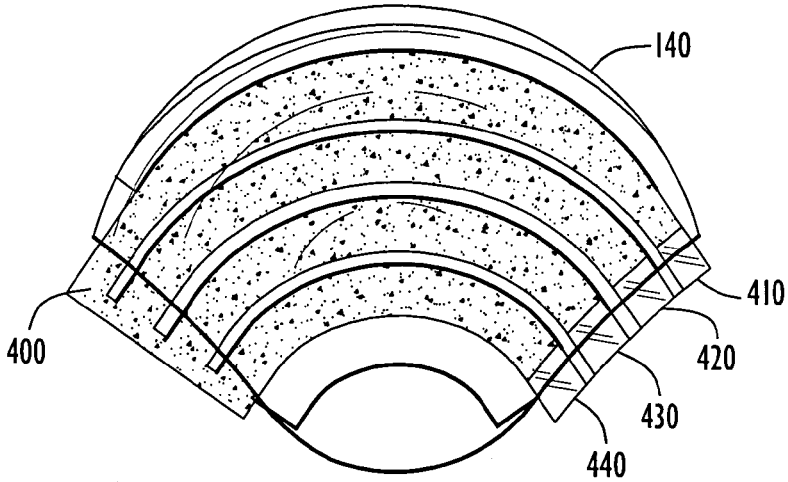
FIG. 5 illustrates close-up view of the front lens cover and light-transmitting member of an infant monitor according to an embodiment of the invention.

FIG. 5 illustrates a close-up view of front lens cover 140 and light-transmitting member 400 of an infant monitor according to an embodiment of the present invention. Front lens cover 140 is mounted on the front of main housing 100 (see FIG. 1) to cover light-transmitting member 400. When illuminated, the individual light-transmitting portions 410, 420, 430, and 440 of light-transmitting member 400 are clearly visible through front lens cover 140.

Figure 6:
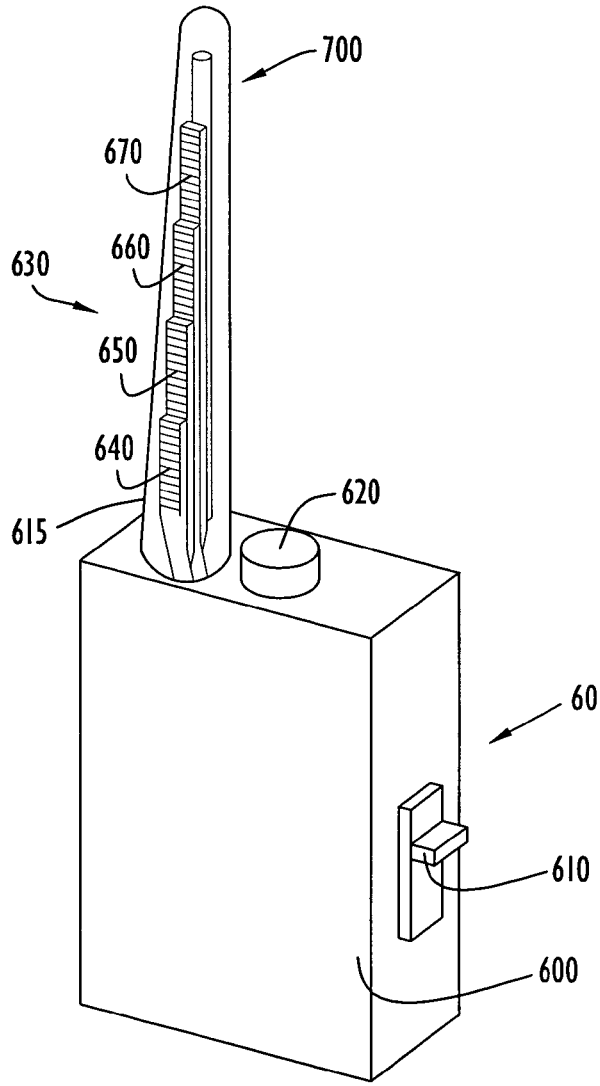
FIG. 6 illustrates a perspective view of an infant monitor according to another embodiment of the invention.

FIG. 6 illustrates a perspective view of an infant monitor according to another embodiment of the invention. In the illustrated embodiment, parent unit 60 includes main housing 600, a speaker (not shown) mounted behind speaker openings (not shown), control knob 620, antenna receiving portion 615, light (visual) display portion 630, and LED test or LED try-me switch 610. As with the embodiment of FIGS. 1–5, in accordance with the present invention, main housing 600 of the illustrated embodiment generally includes conventional electronics associated with a wireless (for example, infrared, radio frequency, or ultrasonic) infant monitor receiver. To the extent such electronics are not specifically disclosed herein, they are well known to those of ordinary skill in the relevant art.

Figure 7:
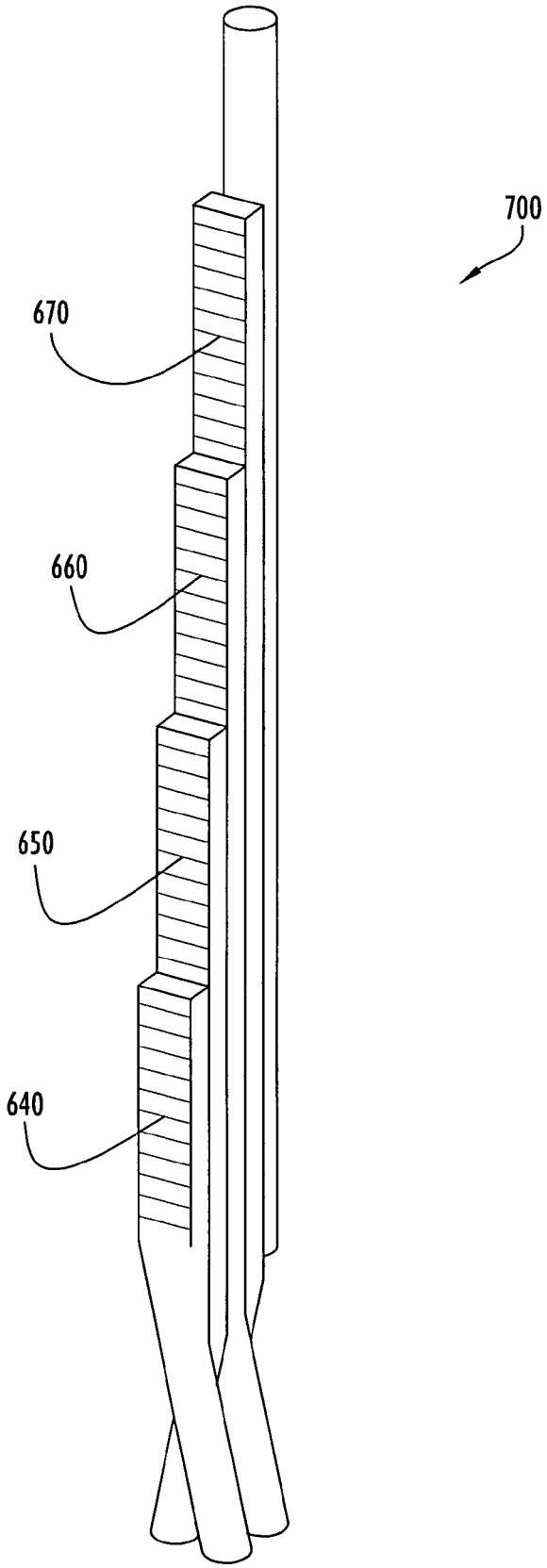
FIG. 7 illustrates a schematic view of the antenna assembly of the infant monitor of FIG. 6.

In the embodiment illustrated in FIGS. 6 and 7, control knob 620 is a multi-function control knob that turns the parent monitor unit off and on. Control knob 620 also acts as a volume control for the speaker (not shown) mounted in housing 600. Thus, control knob 620 may functionally be used to place the parent monitor unit in a light display only mode of operation. In the light display only mode of operation, the speaker mounted in housing 600 is disabled or turned down and the illuminated portion of the light display portion 630 is visible to indicate the receipt of sound indicative signals from the infant unit (transmitter—not shown).

In the embodiment illustrated in FIG. 6, main housing 600 includes antenna receiving portion 615 for receiving an antenna 700. The antenna 700 is adapted to receive signals from an infant unit (transmitter—not shown). In this embodiment, light display portion 630 is mounted in conjunction with antenna 700 to antenna receiving portion 615. Light display portion 630 is made up of individual light-transmitting portions 640, 650, 660, and 670.

As with the embodiment of FIGS. 1–5, one end of each of the individual light-transmitting portions 640, 650, 660, and 670 is mounted in close proximity to an individual LED (the four LEDs are not shown). Thus, each LED only illuminates one individual light-transmitting portion. Thus, one LED only illuminates light-transmitting portion 640, another LED only illuminates light-transmitting portion 650, a third LED only illuminates light-transmitting portion 660, and a fourth LED only illuminates light-transmitting portion 670.

The LEDs may designed to be illuminated sequentially (a first LED only illuminating light-transmitting portion 640, then another LED only illuminating light-transmitting portion 650, then a third LED only illuminating light-transmitting portion 660, and then a fourth LED only illuminating light-transmitting portion 670) or they may be designed to be illuminated on a more random individual basis.

The outer surface of an upper portion of each of individual light-transmitting portions 640, 650, 660, and 670 is textured to enhance the dispersion of the light outwardly from the interior of each individual light-transmitting portion 640, 650, 660, and 670. The light-transmitting portions 640, 650, 660, and 670 may be formed from acrylic or polycarbonate. Alternatively the light-transmitting portions 640, 650, 660, and 670 may be formed from any light-transmitting material.

FIG. 7 illustrates a schematic view of individual light-transmitting portions 640, 650, 660, and 670 of light display portion 630 as well as antenna 700 of the infant monitor 60 of FIG. 6. As shown, antenna 700 is mounted behind the terraced individual light-transmitting portions 640, 650, 660, and 670. The combining of light display portion 630 with antenna 700 allows light display portion 630 to be viewed from various angles by the parent.

During operation of this embodiment, individual LEDs are illuminated to display the increasing intensity or loudness (dB level) of the sounds being detected by the infant unit and transmitted by the infant unit to the parent unit. For example, as the infant's cries become increasingly louder, light-transmitting portion 640 would be illuminated. If the infant's cries become yet louder, light-transmitting portion 650 would be illuminated (along with the previously illuminated light-transmitting portion 640). If the infant's cries still become louder, light-transmitting portion 660 would be illuminated (along with the previously illuminated light-transmitting portions 640 and 650). Finally, if the infant's cries still become yet louder, light-transmitting portion 670 would be illuminated (along with the previously illuminated light-transmitting portions 640, 650, and 660).

The embodiment of FIGS. 6 and 7 illustrates the use of LED test or LED try-me switch 610. LED test or LED try-me switch 610 would be exposed (accessible outside of the packaging) at the point of purchase and would allow the parent to both test the visual output of the light display portion 630 of the parent unit (prior to purchase) and to test the functioning of the light display portion 630 (after purchase and removal from the packaging) without actually receiving sound-representative signals from the infant unit. The LED test or LED "try-me" switch 610 may be wired directly to the power source and the controller (see FIG. 8, for example) to illuminate light display portion 630 without actually receiving sound-representative signals from the infant unit.

Figure 8:
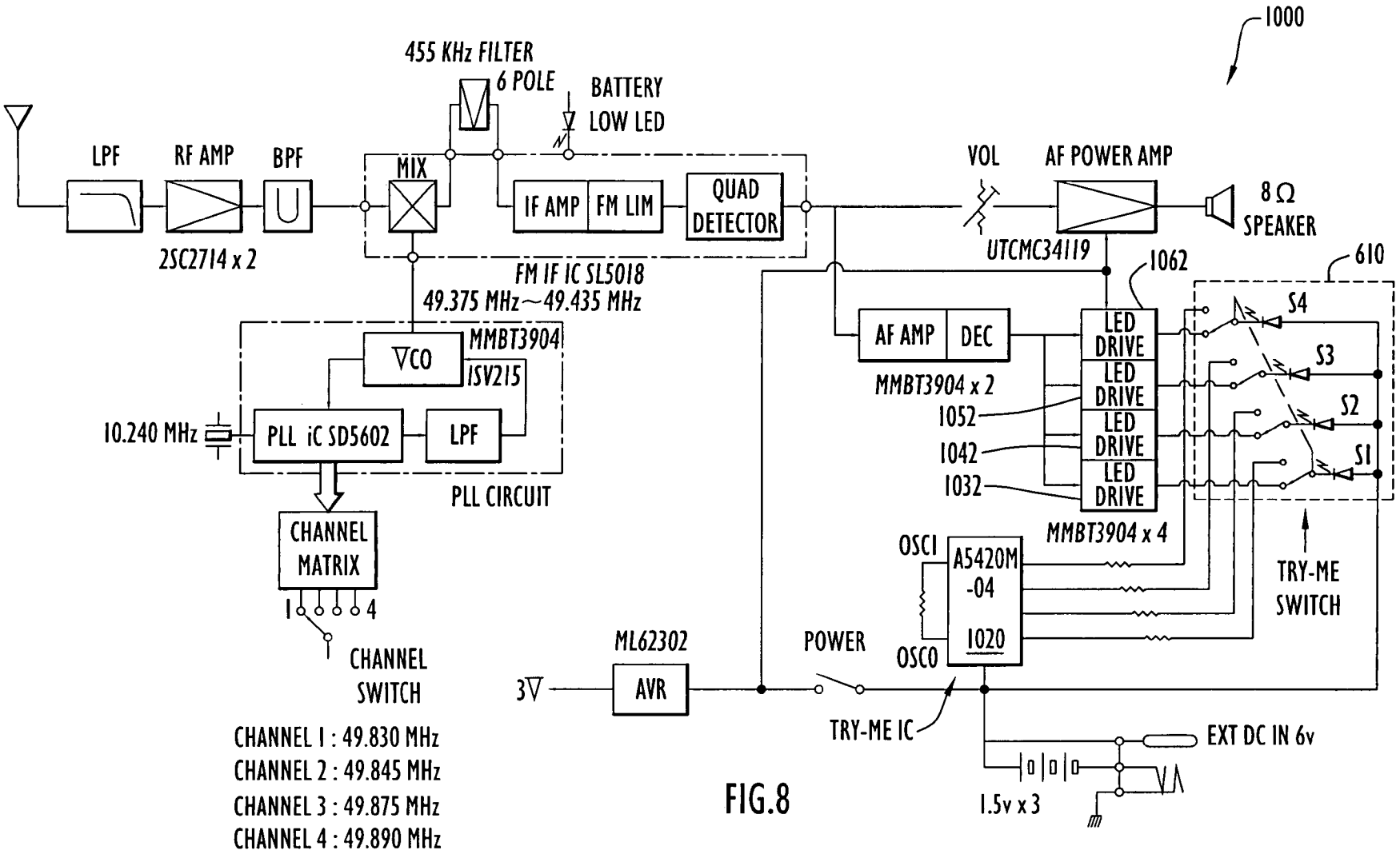
FIG. 8 is a circuit diagram illustrating an exemplary implementation of a LED test/try-me switch in accordance with the present invention.

Referring to FIG. 8, an LED test or LED "try-me" function can be provided by circuit components disposed in the vicinity of the LED test or LED "try-me" switch 610 of circuit 1000. Such circuit components can include, for example, an integrated circuit (IC) 1020 programmed such that activation of the try-me switch (i.e., pressing the button 610) causes sequential illumination of the LEDs via switches S1, S2, S3, and S4 as if corresponding to increasing intensity or loudness (dB level) of the sounds being detected by the infant unit (transmitter) and transmitted by the infant unit to the parent unit (receiver). Each LED is driven by an LED driver 1032, 1042, 1052, and 1062, respectively. "Try-me" IC 1020, for example, is programmed to activate switches S1, S2, S3, and S4 and LED drivers 1032, 1042, 1052, and 1062 in a manner simulating increasing intensity or loudness of (dB level) of the sounds being detected by the infant unit (transmitter) and transmitted by the infant unit to the parent unit (receiver). The remainder of the electronics shown in FIG. 8 are generally conventional electronics associated with a wireless (for example, infrared, radio frequency, or ultrasonic) infant monitor receiver.

Figure 9:
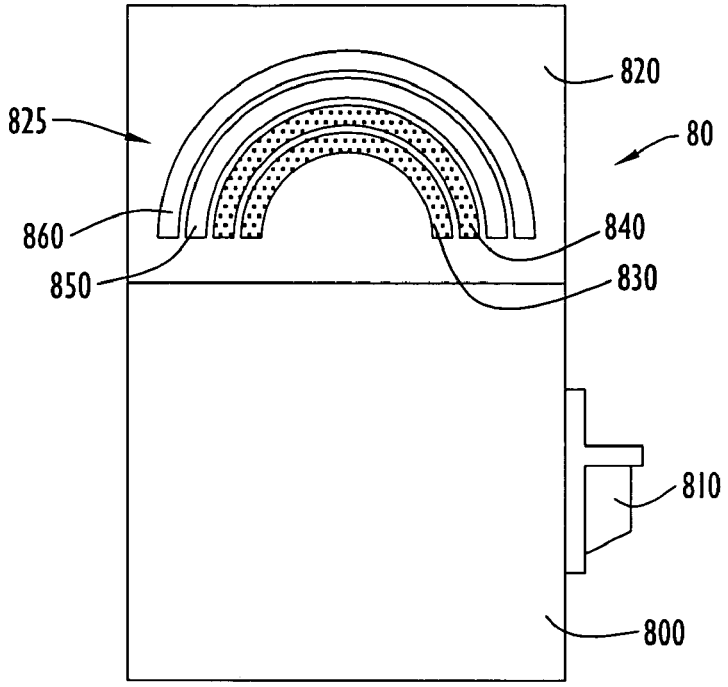
FIG. 9 illustrates a perspective view of an infant monitor according to yet another embodiment of the invention in a first mode of operation.
Figure 10:
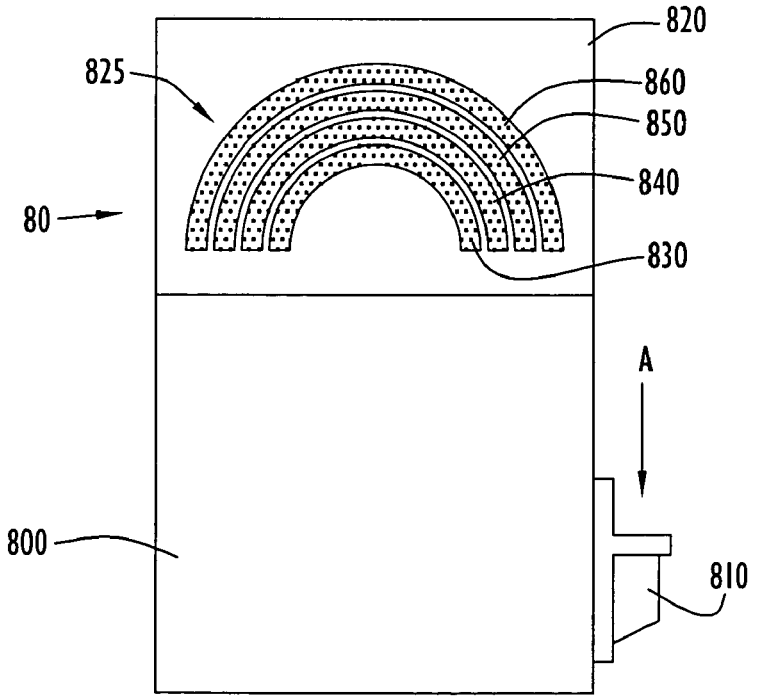
FIG. 10 illustrates a perspective view of the infant monitor of FIG. 9 in a second mode of operation.

FIGS. 9 and 10 illustrate a perspective view of an infant monitor according to yet another embodiment of the invention. In the illustrated embodiment, parent unit 80 (receiver) includes main housing 800, a speaker (not shown) mounted behind speaker openings (not shown), a control knob (not shown), an antenna (not shown), front lens cover 820, light display portion 825, and LED test or LED "try-me" switch 810 (as disclosed above). As with the embodiments previously disclosed herein, in accordance with the present invention, main housing 800 of the illustrated embodiment generally includes conventional electronics associated with a wireless (for example, infrared, radio frequency, or ultrasonic) infant monitor receiver. To the extent such electronics are not specifically disclosed herein, they are well known to those of ordinary skill in the relevant art.

In the illustrated embodiment, control knob (not shown) is a multi-function control knob that turns the parent monitor unit off and on. The control knob also acts as a volume control for the speaker (not shown) mounted in housing 800. Thus, the control knob may functionally be used to place the parent monitor unit in a light display only mode of operation. In the light display only mode of operation, the speaker mounted in housing 800 is disabled or turned down and the illuminated portion of the light display portion 825 is visible to indicate the receipt of sound indicative signals from the infant unit (transmitter—not shown).

Like the embodiment illustrated in FIGS. 1–5, light display portion 825 is made up of individual light-transmitting portions 830, 840, 850, and 860. This embodiment also illustrates the use of LED test or LED "try-me" switch 810. LED test or LED "try-me" switch 810 would be exposed (accessible outside of the packaging) at the point of purchase and would allow the parent to both test the visual output of the light display portion 825 of the parent unit (prior to purchase) and to test the functioning of the light display portion 825 (after purchase and removal from the packaging) without actually receiving sound-representative signals from the infant unit. The LED test or LED "try-me" switch 810 may be wired directly to the power source and the controller (see FIG. 8, for example) to illuminate light display portion 825 without actually receiving sound-representative signals from the infant unit.

FIGS. 9 and 10 illustrate both the visual appearance of an infant monitor unit (in-use) as well as the performance of an LED test or LED "try-me" switch in accordance with the present invention. During operation, individual LEDs are illuminated to display the increasing intensity or loudness (dB level) of the sounds being detected by the infant unit and transmitted by the infant unit to the parent unit (receiver). For example, as the infant's cries become increasingly louder, light-transmitting portion 830 would be illuminated. As shown in FIG. 9, if the infant's cries become yet louder, light-transmitting portion 840 would be illuminated (along with the previously illuminated light-transmitting portion 830). If the infant's cries still become louder, light-transmitting portion 850 would be illuminated (along with the previously illuminated light-transmitting portions 830 and 840). Finally, as illustrated in FIG. 10, if the infant's cries still become yet louder, light-transmitting portion 860 would be illuminated (along with the previously illuminated light-transmitting portions 830, 840, and 850). An LED test or LED "try-me" switch 810 in accordance with this invention would also illuminate the light display portion of the monitor as described above, without actually receiving sound-representative signals from the infant unit. As an example and as illustrated in FIG. 10, LED test or LED "try-me" switch 810 in accordance with this invention could be actuated by pressing switch 810 down (as indicated by arrow A) to illuminate the light display portion of the monitor as described above.

While the invention has been described in detail and with reference to specific embodiments thereof, it will be apparent to one skilled in the art that various changes and modifications can be made therein without departing from the spirit and scope thereof. For example, although the present invention is described in terms of an infant monitor receiving unit, the invention is equally applicable to an infant monitor transmitting unit. Thus, it is intended that the present invention covers the modifications and variations of this invention provided they come within the scope and spirit of the appended claims and their equivalents.

We claim:

1. A light display apparatus for an infant monitor receiver including an antenna operable to receive a signal indicative of sound received by an infant monitor transmitter, the light display apparatus comprising:

a plurality of individual light sources;

a plurality of elongated light transmitting portions, each of the light transmitting portions including a first end, a second end, and an exterior surface, the exterior surface being positioned between the first end and the second end, and each of the elongated light transmitting portions being associated with only one of the light sources at its first end such that the illumination of one of the light sources transmits light through an associated elongated light transmitting portion from its first end to its second end and radiates light outward from its exterior surface, wherein the illumination of each light source is in response to receiving the signal indicative of sound, the signal corresponding to a monitored sound level or intensity, and wherein the illumination of each of the light sources is sequential as the monitored sound level or intensity increases; and a light display try-me switch operable to sequentially illuminate the plurality of individual light sources in the absence of receipt of the signal indicative of sound received by the infant monitor transmitter.

2. The apparatus of claim 1, wherein the elongated light transmitting portions are arranged in a radial pattern.

3. The apparatus of claim 1, wherein the elongated light transmitting portions are curvilinear in shape.

4. A light display apparatus for an infant monitor receiver which includes an antenna operable to receive a signal indicative of sound received by an infant monitor transmitter and mounted on an external portion of a housing, the light display apparatus forming part of the antenna and comprising:

a plurality of individual light sources; and a plurality of elongated light transmitting portions each including a first end, a second end, and an exterior surface positioned between the first end and the second end, wherein each of the plurality of the elongated light transmitting portions is associated with only one of the plurality of light sources at its first end such that the illumination of an individual light source transmits light through the associated elongated light transmitting portion from its first end to its second end and radiates light outward from its exterior surface, wherein each of the individual light sources is sequentially illuminated in response to receiving the signal indicative of sound, the signal corresponding to a monitored sound level or intensity.

5. The apparatus of claim 4, wherein the illumination of each of the light sources is sequential as the monitored sound level or intensity increases.

6. The apparatus of claim 4, further comprising a light display try-me switch operable to sequentially illuminate the plurality of individual light sources in the absence of receipt of the signal indicative of sound received by the infant monitor transmitter.

7. An infant monitor receiver comprising:

an antenna operable to receive a signal indicative of sound received by an infant monitor transmitter;

a display portion for producing a visual display including a plurality of individual light sources adapted to be sequentially illuminated in response to receiving the signal indicative of sound, wherein the signal and the sequential illumination correspond to a monitored sound level or intensity; and a visual display try-me switch operable to sequentially illuminate the plurality of individual light sources in the absence of receipt of the signal indicative of sound received by the infant monitor transmitter.

8. The monitor receiver or transmitter of claim 7, wherein the light sources are arranged in a radial pattern.

9. An infant monitor receiver including a variable visual display, the visual display varying in accordance with a monitored sound level or intensity, the infant monitor receiver comprising:

means for receiving a signal indicative of sound received by an infant monitor transmitter;

means for sequentially illuminating a plurality of light sources in response to receiving the signal indicative of sound, wherein the signal corresponds to the monitored sound level or intensity, and the illumination of each of the plurality of light sources is sequential as the monitored sound level or intensity increases; and a visual display try-me switch for activating the variable visual display in the absence of receipt of the signal indicative of sound received by the infant monitor transmitter, whereby the plurality of light sources are sequentially illuminated when activated by the visual display try-me switch for activating the variable visual display.

10. An infant monitor receiver for monitoring the sound of an infant comprising:

a housing;

an antenna mounted on the housing operable to receive a signal indicative of sound received by an infant monitor transmitter;

a light display including:

a plurality of individual light sources; and a plurality of elongated light transmitting portions, each of the light transmitting portions including a first end, a second end, and an exterior surface, the exterior surface being positioned between the first end and the second end, and each of the elongated light transmitting portions being associated with only one of the light sources at its first end such that the illumination of one of the light sources transmits light through an associated elongated light transmitting portion from its first end to its second end and radiates light outward from its exterior surface, wherein the illumination is in response to receiving the signal indicative of sound, the signal corresponds to a monitored sound level or intensity, and the illumination of each of the light sources is sequential as the monitored sound level or intensity increases; and a light display try-me switch operable to sequentially illuminate the plurality of individual light sources in the absence of receipt of the signal indicative of sound.

11. The infant monitor of claim 10, wherein the light display forms a portion of the housing.

12. The infant monitor of claim 10, wherein the light display forms a portion of the antenna.

13. In an infant monitor receiver comprising a housing, an antenna mounted on the housing operable to receive a signal indicative of a level or intensity of sound received by an infant monitor transmitter, and a variable visual display including a plurality of individual light sources sequentially illuminated corresponding to the level or intensity, a method of activating the variable visual display comprising the step of:

activating a visual display try-me switch to energize the variable visual display in the absence of receipt of the signal indicative of a level or intensity of sound received by the infant monitor transmitter, whereby the plurality of individual light sources are sequentially illuminated.

* * * * *

UNITED STATES PATENT AND TRADEMARK OFFICE

CERTIFICATE OF CORRECTION

PATENT NO. : 7,088,259 B2
APPLICATION NO. : 10/822728
DATED : August 8, 2006
INVENTOR(S) : Armbruster et al.

It is certified that error appears in the above-identified patent and that said Letters Patent is hereby corrected as shown below:

On the title page, item:
(56) References Cited, insert:

U.S. Patent Documents

| | | | |
|---|---|---|---|
| 2002/0186129 | A1 | Rebello | 12/12/2002 |
| 2002/0135485 | A1 | Arakawa | 09/26/2002 |
| 6,496,115 | B2 | Arakawa | 12/17/2 002 |
| 6,164,792 | | Nakagome | 12/26/2000 |
| 5,912,624 | | Howard, II | 06/15/1999 |
| 5,818,342 | | Solomon et al. | 10/06/1998 |
| 5,774,558 | | Drucker | 06/30/1998 |
| 5,289,355 | | Cimock | 02/22/1994 |
| 4,785,291 | | Hawthorne | 11/15/1988 |
| 4,529,973 | | Blamberg | 07/16/1985 |
| 4,528,501 | | Dorrough et al. | 07/09/1985 |
| 4,440,059 | | Hunter | 04/03/1984 |
| 4,424,511 | | Alberts, Jr. | 01/03/1984 |
| 4,346,374 | | Groff | 08/24/1982 |
| 3,480,912 | | Speeth et al. | 11/25/1969 |
| 3,440,349 | | Gibbs | 04/22/1969 |
| 2,486,890 | | Stanmyre | 11/01/1949 |
| Des. 404,733 | | Crosby | 01/26/1999 |
| Des. 340,928 | | Knoedler et al. | 11/02/1993 |

Signed and Sealed this

Sixteenth Day of January, 2007

JON W. DUDAS
*Director of the United States Patent and Trademark Office*